US010143051B2

(12) United States Patent
Liu et al.

(10) Patent No.: US 10,143,051 B2
(45) Date of Patent: Nov. 27, 2018

(54) BLEEDER CIRCUIT AND CONTROL METHOD THEREOF, AND LED CONTROL CIRCUIT

(71) Applicant: JOULWATT TECHNOLOGY (HANGZHOU) CO., LTD., Hangzhou, Zhejiang (CN)

(72) Inventors: Guoqiang Liu, Zhejiang (CN); Pitleong Wong, Zhejiang (CN); Yuancheng Ren, Zhejiang (CN); Xunwei Zhou, Zhejiang (CN)

(73) Assignee: JOULWATT TECHNOLOGY (HANGZHOU) CO., LTD., Hangzhou, Zhejiang (CN)

( * ) Notice: Subject to any disclaimer, the term of this patent is extended or adjusted under 35 U.S.C. 154(b) by 0 days.

(21) Appl. No.: 15/490,002

(22) Filed: Apr. 18, 2017

(65) Prior Publication Data

US 2018/0139816 A1 May 17, 2018

(30) Foreign Application Priority Data

Nov. 16, 2016 (CN) ..... 2016 1 1030982
Nov. 16, 2016 (CN) ..... 2016 2 1252478 U

(51) Int. Cl.
*H05B 37/02* (2006.01)
*H05B 33/08* (2006.01)

(52) U.S. Cl.
CPC ..... *H05B 33/0845* (2013.01); *H05B 33/0812* (2013.01); *H05B 33/0815* (2013.01)

(58) Field of Classification Search
CPC .... H05B 41/34; H05B 33/0803; H05B 39/09; H05B 41/28; H05B 33/0809;
(Continued)

(56) References Cited

U.S. PATENT DOCUMENTS 9,214,851 B1 * 12/2015 Mao ..... H02M 1/08
2012/0242238 A1 * 9/2012 Chen ..... H05B 33/0815 315/200 R (Continued)

*Primary Examiner* — Minh D A
(74) *Attorney, Agent, or Firm* — Charles C. Achkar; Ostrolenk Faber LLP

(57) ABSTRACT

The present disclosure discloses a bleeder circuit and a control method thereof, and an LED control circuit. The present disclosure is applied in an LED control circuit of TRIAC dimming, directly or indirectly detects cross-zero point of input voltage; after cross-zero point of the input voltage is delayed by a second time, the bleeder module works to generate bleeder current, and a time between turn-on time of the TRIAC and a time that a driving circuit input current achieves a predetermined value (maintaining current of TRIAC) is a first time. During the first time, the bleeder circuit generates losses; when the first time is greater than a predetermined value, the second time is prolonged; when the first time is smaller than the predetermined value, the second time is reduced, such that the first time is close to or equal to the predetermined value. By using the present disclosure, the second time, which is used as the delay time, is self-adaptively adjusted according to the first time and the predetermined value, and the bleeder power consumption is reduced and system efficiency is enhanced.

10 Claims, 12 Drawing Sheets

(58) Field of Classification Search
CPC ..... H05B 41/295; H05B 41/2827; H05B 41/3925; H05B 33/0815; H05B 33/0818; H05B 41/2828; H05B 41/3921; H05B 41/3927; H05B 37/029; H05B 33/0827; H05B 33/0821; Y02B 20/202; G01R 31/3336; G03B 15/0452; G05D 25/02; H01H 9/0066; F21Y 2101/02
See application file for complete search history.

(56) References Cited

U.S. PATENT DOCUMENTS

2013/0278159 A1* 10/2013 Del Carmen, Jr. ..... H05B 33/0809 315/200 R
2013/0343090 A1* 12/2013 Eom ..... H02M 3/33507 363/16

* cited by examiner

BLEEDER CIRCUIT AND CONTROL METHOD THEREOF, AND LED CONTROL CIRCUIT

CROSS REFERENCE TO RELATED APPLICATIONS

The present application claims priority to Chinese Application No. 201611030982.4, filed on Nov. 16, 2016, and Chinese Application No. 201621252478.4, filed on Nov. 16, 2016, the subject matter of each of which is incorporated by reference in their entirety.

FIELD OF THE INVENTION

The present disclosure relates to the technical field of power electronic, more particularly, to a bleeder circuit and a control method thereof, and an LED control circuit.

BACKGROUND OF INVENTION

LED lamps are more energy-saving and environment friendly than traditional fluorescent lamps and incandescent lamps, and thus LED lamps are replacing the current fluorescent lamps and incandescent lamps. In incandescent lamps with a TRIAC dimmer, it is also expected to be replaced by LED lamps, and thus LED needs a compatible TRIAC dimmer. However, when the LED lamps replace incandescent lamps, since when the TRIAC is turned on, the voltage at its output terminal will have great voltage change rate (dv/dt), great surge current will be generated at the input terminal. The surge current has great shock amplitudes, and the duration time is short, easy to cause erroneous turning-off of TRIAC, affect the stable work of the LED driving circuit, make the LED lamp flicker; in addition, the input current of the TRIAC device needs to be greater than its maintaining current; when the input current is smaller than the maintaining current, it is easy to turn off TRIAC, which also causes the flickering of the LED. In order to solve the above technical problem, the prior art uses the following solution, but still has certain technical defects.

The circuit principle diagram as shown in FIG. 1 shows a prior art bleeder circuit, i.e., a Current source I10 and a regulating tube M00 are connected in series to form a bleeder circuit, and the current source I10 may be replaced by a resistor. When the TRIAC dimmer is turned on, it is difficult for the linear LED driving circuit current to achieve the maintaining current of the TRIAC dimmer, the regulating tube M00 of the bleeder circuit is turned on, and the bleeder circuit generates bleeder current iblr, to make the input current achieves the maintain current. FIG. 2 shows waveforms the input voltage vin and the input current iin, and the shadow part is the current generated by the bleeder circuit, and this part of bleeder current will generate additional power consumption. Moreover, the bigger the turning-on angle of the TRIAC dimmer is, the longer time t1 that the bleeder circuit generates the bleeder current iblr is, and the bigger the power consumption is, the lower the conversion efficiency is.

SUMMARY OF THE INVENTION

In view of this, the objective of the present disclosure is to provide a bleeder circuit with small power consumption and high efficiency and a method thereof, and an LED control circuit, to solve the technical problems in the prior art.

The technical solution of the present disclosure is to provide a bleeder circuit with the following structure, comprising:

A bleeder module, AC input through a TRIAC dimmer and a rectifying bridge to get input voltage to provide a load with Current source through a driving circuit, two ends of the bleeder module being connected to high and low potential terminals of the input voltage respectively;

A bleeder control circuit, connected to a control terminal of the bleeder module; directly or indirectly detecting cross-zero point of input voltage; after the cross-zero point of input voltage is delayed by a second time, the bleeder module is controlled to generate bleeder current, and when the input current of the driving circuit achieves the predetermined value, the bleeder current is zero; a time between turn-on time of the TRIAC dimmer and a time that a driving circuit input current achieves a predetermined value is a first time;

Wherein when the first time is greater than a reference time, the second time is prolonged; when the first time is smaller than the reference time, the second time is reduced, such that the first time is close to the reference time.

As an exemplary embodiment, the bleeder control circuit includes an input voltage detecting circuit, a input current detecting circuit of driving circuit, and a logic circuit; the logic circuit is connected to a control terminal of a bleeder module, and the input voltage detection circuit samples the input voltage; when the input voltage sample signal achieves a threshold voltage, after being delayed for a second time, the bleeder module is controlled by the logic circuit to generate bleeder current; the input current detecting circuit of driving circuit detects the input current of driving circuit, and when the sample current achieve the a threshold current indicating a predetermined current, the bleeder current is controlled by the logic circuit to be zero; comparing the first time with the reference time, and adjusting the second time correspondingly according to comparison result.

As an exemplary embodiment, the bleeder control circuit further includes a time-delay module and a time comparison module, the time delay module being connected to an output terminal of the input voltage detection circuit, the logic circuit and the time comparison module, and the time delay module is for, when the input voltage sample signal achieves the threshold voltage, delaying the second time, and after the delay is finished, controlled by the logic circuit to generate bleeder current, comparing the first time with the reference time in the time comparison module, and feeding back comparison result to the time delay module to adjust the second time.

As an exemplary embodiment, the logic circuit includes a first trigger and a second trigger, the time delay module outputs a state signal to indicate whether time delay is finished, and a set terminal of the first trigger receives the state signal to indicate whether the time delay is finished, and an output terminal of the input voltage detecting circuit and the output terminal of the time-delay module are connected to an NAND gate respectively, the output terminal of the NAND gate being connected to a reset terminal of the first trigger; the output terminal of the first trigger is connected to the set terminal of the second trigger after it is reversed; the output terminal of the input current detecting circuit of driving circuit is connected to the reset terminal of the second trigger after it is reversed; the output terminal of the second trigger and the output terminal of the input current detection circuit of driving circuit are connected to two input terminals of an AND gate respectively, the output terminal of the AND gate and the output terminal of the second trigger are connected to two input terminals of an OR gate respectively, the OR gate outputs a signal to indicate whether to enable to the bleeder module, and the output terminal of the AND gate outputs a timing signal to indicating the first time.

As an exemplary embodiment, the bleeder control circuit includes a input current detecting circuit of driving circuit, the bleeder current detecting circuit, and a logic circuit, the logic circuit being connected to the control terminal of the bleeder module, the input current detecting circuit of driving circuit samples the driving circuit input current and compares it with the threshold current; during the detection of input voltage cross-zero point, the bleeder current detecting circuit, when the logic circuit controls the bleeder module to generate bleeder current, samples the bleeder current, and compares it with the bleeder threshold; when the input current of driving circuit is lower than the threshold current, timing starts, and timing is finished until the bleeder current achieves the bleeder threshold, the timing time being used as a third time.

As an exemplary embodiment, When the input current of driving circuit is lower than the threshold current, it is determined that the input voltage achieves the cross-zero point after the third time, and the third time may be updated regularly or irregularly.

As an exemplary embodiment, when it is determined that the input voltage achieves the cross-zero point and then the second time is delayed, the bleeder module is controlled by the logic circuit to generate bleeder current; the input current detecting circuit of driving circuit detects the input current of driving circuit, and when the sample current achieves the threshold current indicating a predetermined value, the bleeder current is zero after being controlled by the logic circuit; comparing the first time and the reference time, and adjusting the second time correspondingly according to the comparison result.

As an exemplary embodiment, the bleeder control circuit further comprises a time delay module, a time comparison module, and a cross-zero determining module, the time delay module being connected to the output terminal of the cross-zero determining module, the logic circuit, and the time comparison module respective, the cross-zero determining module being connected to the output terminal of the bleeder current detecting circuit and the output terminal of input current detecting circuit of the driving circuit respectively; timing the third time by the cross-zero determining module, and determining the cross-zero time of the input voltage; the time-delay module receives a signal indicating the cross-zero time output by the cross-zero determining module, and then delays the second time, after the time delay is finished, bleeder circuit is generated by controlling the logic circuit; comparing the first time and the reference time in the time comparison module, and feeding back the comparison result to the time delay module to adjust the second time.

As an exemplary embodiment, the logic circuit comprises a third trigger and a fourth trigger, the time delay module outputs a state signal to indicate whether the time delay is finished; the set terminal of the third trigger receives the state signal to indicate whether the time delay is finished; the output terminal of the cross-zero determining module and the output terminal of the time delay module are connected to the NAND gate respectively, and the output terminal of the NAND gate are connected to the reset terminal of the third trigger; the output terminal of the third trigger is connected to the setting terminal of the fourth trigger after it is reversed, the output terminal of the input current detecting circuit driving circuit is connected to the reset terminal of the fourth trigger after it is reversed, the output terminal of the fourth trigger and the output terminal of the input current detecting circuit of driving circuit are connected to two input terminals of the first AND gate, and the output terminal of the input current of driving circuit and the signal indicating whether the cross-zero determining module is enabled to access the input terminals of the second AND gate; the output terminal of the first AND gate, the output terminal of the second AND gate, and the output terminal of the third trigger are connected to three input terminals of an OR gate, the OR gate outputs the signal to indicate whether to enable to the bleeder module, the output terminal of the first AND gate outputs a timing signal indicating the first time.

Another technical solution of the present disclosure is to provide a control method of a bleeder circuit with following steps:

AC input through a TRIAC dimmer and a rectifying bridge to get an input voltage to provide a load with power supply through a driving circuit, two terminals of the bleeder module being connected to high and low potential terminals of the input voltage respectively;

Directly or indirectly detecting the cross-zero point of input voltage, after cross-zero point of the input voltage is delayed for a second time, controlling the bleeder module to generate bleeder current, and the bleeder current is controlled to be zero when the input current of the driving circuit achieves the predetermined value; the time between the turn-on time of the TRIAC dimmer and a time that the input current of the driving circuit achieves the predetermined value is a first time;

Wherein when the first time is greater than the reference time, the second time is prolonged; when the first time is smaller than the reference time, the second time is shortened to make the first time close to the reference time.

Another technical solution of the present disclosure is providing an LED control circuit with the following structure, which includes the above bleeder circuit and the LED driving circuit, and the LED driving circuit is a linearly driving circuit or a switching circuit.

Compared with the prior art, using the circuit structure and method of the present disclosure has the following advantages: the present disclosure is applied in an LED control circuit of TRIAC dimming, directly or indirectly detects cross-zero point of input voltage; after the input voltage cross-zero point is delayed by a second time, the bleeder module works to generate bleeder current, and a time between turn-on time of a TRIAC dimmer and a time that a driving circuit input current achieves a predetermined value (maintaining current of the TRIAC dimmer) is a first time. During the first time, the bleeder circuit generates losses; when the first time is greater than a predetermined value, the second time is prolonged; when the first time is smaller than the predetermined value, the second time is reduced, such that the first time is close to or equal to the predetermined value. By using the present disclosure, the second time, which is used as the delay time, is self-adaptively adjusted according to the first time and the predetermined value, and the bleeder power consumption is reduced and system efficiency is enhanced.

BRIEF DESCRIPTIONS OF THE DRAWINGS

DESCRIPTION OF THE PREFERRED EMBODIMENTS

The following will describe in great detail the preferred embodiments of the present disclosure by combining the accompanying drawings, but the present disclosure is not limited to these embodiments. The present disclosure covers any replacement, amendment, equivalent methods and solutions made within the sprits and scopes of the present disclosure.

In order to make the public to thoroughly understand the present disclosure, the following details are described in detail in the preferred embodiments of the present disclosure, and those skilled in the art may totally understand the present disclosure without the descriptions of these details.

The present disclosure will be described in detail by way of example in the following paragraphs. It needs to be explained that the accompanying drawings all use simplified forms and use non-accurate ratios, and are merely for describing the objectives of the embodiments of the present disclosure conveniently and clearly.

Figure 1:
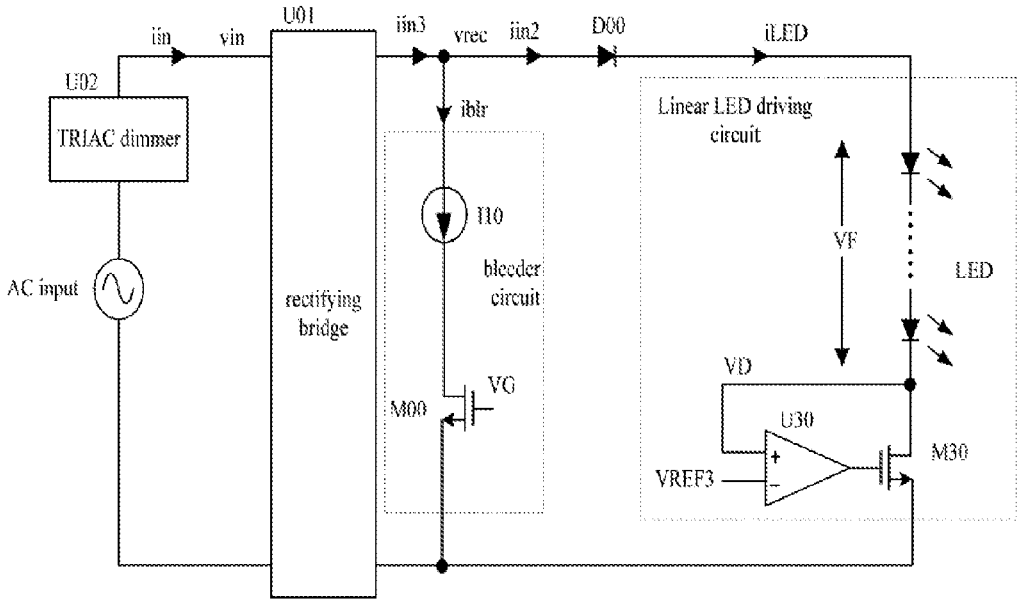
FIG. 1 is a structural schematic view of a prior art TRIAC LED control circuit applied with a bleeder circuit.
Figure 2:
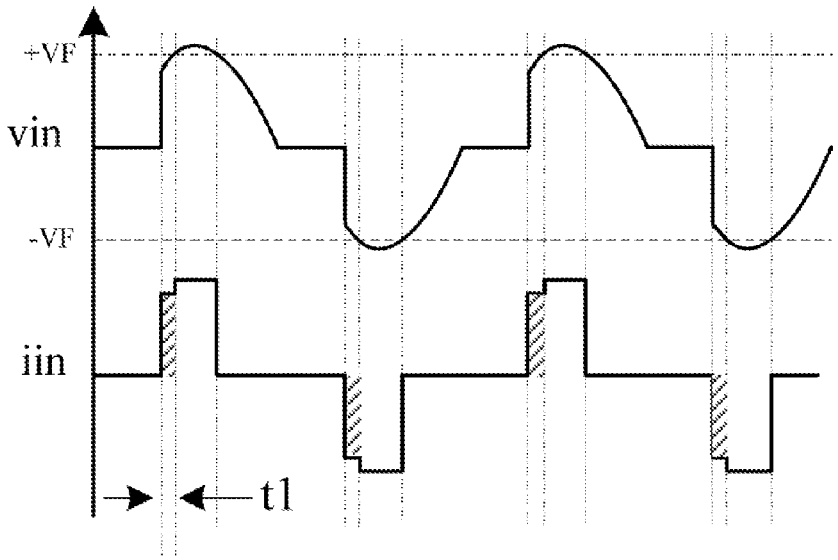
FIG. 2 is a prior art working waveform graph of FIG. 1.
Figure 3:
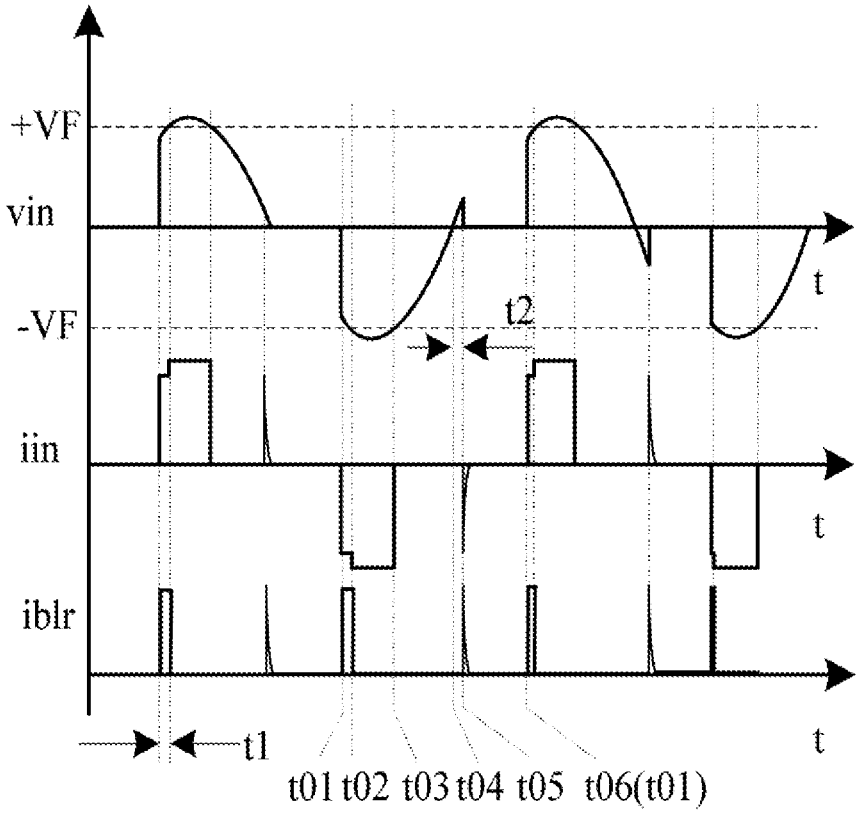
FIG. 3 is a working waveform graph of the bleeder circuit of the present disclosure.

FIG. 3 shows a working waveform of a bleeder circuit of the present disclosure. The figure shows waveforms of input voltage Vin, input current iin, and a bleeder current iblr. By directly or indirectly detecting the Vin cross-zero point of input voltage, when the input voltage achieves the cross-zero point, the second time t2 is delayed, and the bleeder circuit is controlled to generate bleeder current iblr, and the time between the turn-on time of the TRIAC dimmer and the time that the input current iin2 of driving circuit achieves the predetermined value (generally it is the maintaining current of TRIAC dimmer) is the first time t1. Within the first time t1, the bleeder circuit produces losses; when t1 is greater than a predetermined value T, the second time t2 is increased; when t1 is smaller than a predetermined value T, the second time t2 is reduced to make the first time be close to or equal to the predetermined value T. In the figure, +VF and −VF are equal to the turn-on threshold of the diode.

Figure 4:
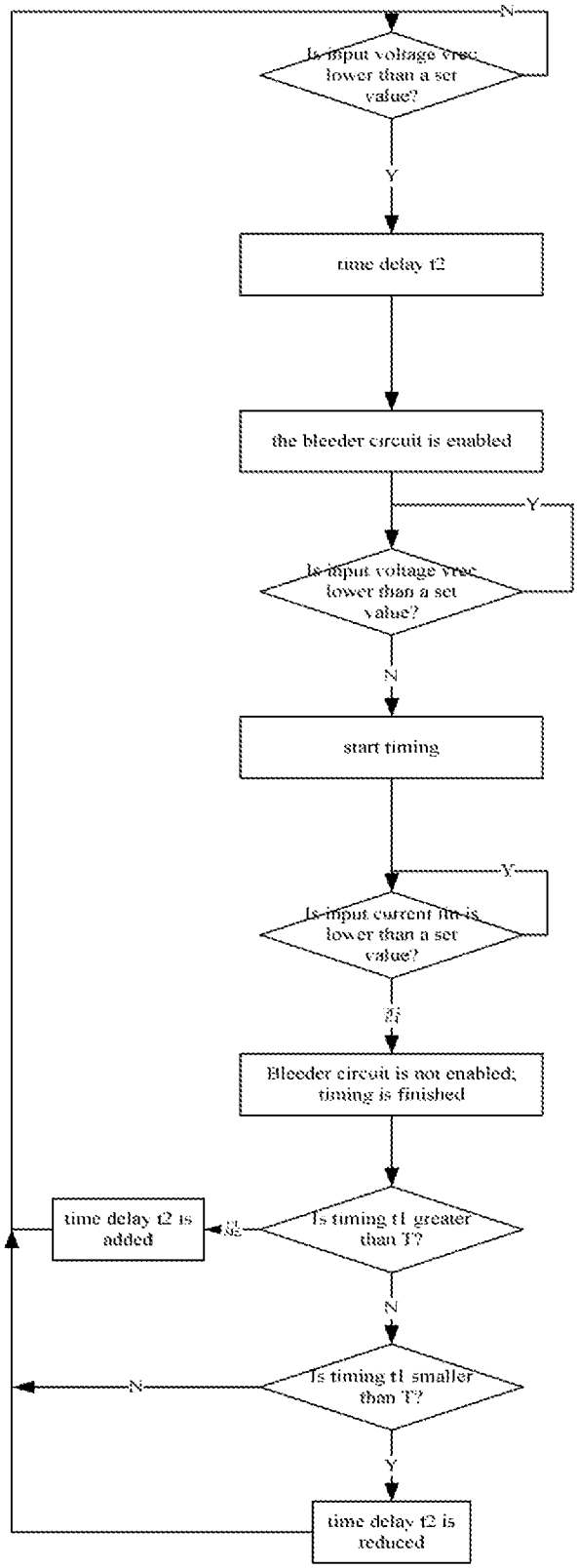
FIG. 4 is a flowchart diagram of the present disclosure.

FIG. 4 shows a flowchart diagram of the bleeder circuit of the present disclosure. First it is determined whether the input voltage Vin achieves cross-zero, and a threshold voltage close to zero is compared with the sample voltage, or the time that the input voltage Vin is cross-zero can be obtained indirectly by other ways. The input voltage Vin is the input voltage Vin that the alternating current input passes through the silicon controlled light regulator. After the input voltage is cross-zero and then the second time t2 is delayed, the bleeder module is controlled to be enabled to generate bleeder current ibir. When the input voltage Vin is cross-zero, timing starts, and the input current iin2 of the driving circuit achieves the predetermined value (usually the maintaining current of the TRIAC dimmer is used), and then the bleeder circuit is not enabled, and the bleeder current is zero, and at this time timing is finished; the above timing time is the time between the turn-on time of the TRIAC dimmer and the time that the input current of the driving circuit achieves the predetermined value, and it is the first time t1. When the first time t1 is greater than reference time T, the second time t2 is prolonged; when the first time 1 is smaller than reference time TI, the second time t2 is reduced, to make the first time is close to the reference time T. The bleeder time is reduced by this method above, reduces the bleeder power consumption, and improves system efficiency.

Figure 5:
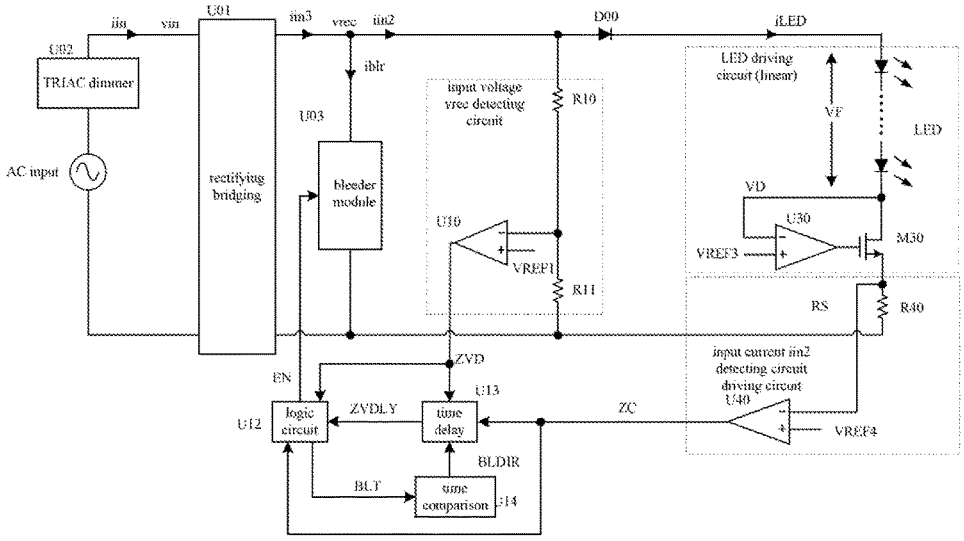
FIG. 5 is a circuit structural diagram of embodiment one of the bleeder circuit of the present disclosure.

FIG. 5 shows a circuit structure of embodiment one of the bleeder circuit of the present disclosure, applied in the LED control circuit of the TRIAC dimmer. The LED control circuit comprises a bleeder circuit and an LED driving circuit, and the bleeder circuit comprises a bleeder module and a bleeder control circuit, and the bleeder circuit is for solving the flickering problem caused since the input current is too small under the TRIAC dimmer, and overcomes the technical defect existing in the prior art. The input power is an AC input, and the AC input outputs direct current input voltage vrec through the TRIAC dimmer U02 and the rectifier U01, i.e., as input voltage of the LED load. The AC input may be connected to the rectifier U01 through the TRIAC dimmer U02, the positive output terminal of the rectifier is connected to the anode of the diode D00, and the positive terminal of the LED driving circuit is connected to the cathode of the diode D00. Usually the LED driving circuit is certain capacitive, and thus diode D00 is added into the vrec and the LED driving circuit; when the absolute value of the AC input is decreased, due to capacitance, the voltage decreases slowly, and sample resistor of input voltage vrec detecting circuit added with diode D00 will make the vrec voltage follow the absolute value of the AC input, so as to ensure the accuracy to sample the input voltage.

The bleeder circuit includes a bleeder module and a bleeder control circuit, and the bleeder module comprises a regulating tube and a Current source or a resistor connected in series with the regulating tube. The main improvement of the present disclosure lies in the bleeder control circuit and the corresponding control method. The bleeder control circuit comprises an input voltage vrec detecting circuit, a input current detecting circuit of driving circuit and a logic circuit U12, and the logic circuit U12 is connected to the control terminal of the bleeder module U03, and the input voltage vrec detecting circuit samples input voltage; when the input voltage sample signal achieves the threshold voltage VREF1 (compare in the comparator U10), then after the second time t2 is delayed, the bleeder control module U03 is controlled by the logic circuit U12 to generate bleeder current iblr; The input current detecting circuit of driving circuit detects input current iin2 of the driving circuit; when the sample current achieves the threshold current VREF4 indicating the predetermined value (compare in comparator U40), the bleeder current iblr is zero after being controlled by the logic circuit U12; the first time t1 is compared with the reference time T, and the second time t2 is adjusted correspondingly according to the comparison result. When the driving circuit is a linear driving circuit, the current flowing through the regulating tube M30 of the linear driving circuit is sampled, i.e., it may be used to indicate input current in2 of the driving circuit.

The bleeder control circuit further includes a time delay module U13 and a time comparison module U14, and the time-delay module U13 is for time-delaying the input voltage cross-zero point signal ZVD generated by the input voltage detecting circuit, and after the time delay is finished, the signal is passed to logic circuit U12, so as to enable the bleeder module U03. Time comparison module U14 is for comparing the first time t1 and the reference time T, so as to perform feedback adjustment of the second time t2. The time delay module U13 is connected to the output terminal of the input voltage vrec detecting circuit, the logic circuit U12, and the time comparison module U14, and the time delay module U13 delays the second time t2 when the input voltage sample signal achieves the threshold voltage VREF1, and after the time delay is finished, controlling by the logic circuit U12 to generate bleeder current iblr; in the time comparison module U14, the first time t1 is compared with the reference time T, and the comparison result feedbacks to the time delay module to adjust the second time t2.

Figure 6:
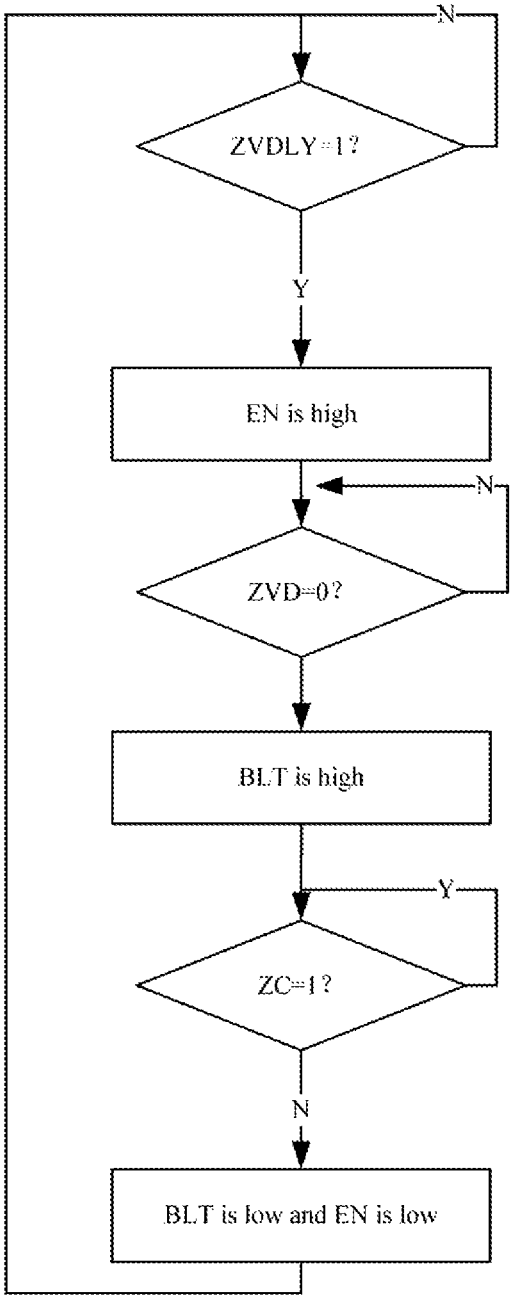
FIG. 6 is a flowchart block diagram of a logic circuit of embodiment one of the bleeder circuit of the present disclosure.

FIG. 6 shows a flowchart of logic circuit U12 of embodiment one of the bleeder circuit of the present disclosure. By combining FIG. 5, it is obtained that the specific implementing steps of embodiment one are obtained as: the initial value of t2 is 0. The AC power, after passing through the TRIAC dimmer U02 and the rectifying bridging U01, obtains the rectified voltage vrec. Resistors R10 and R11 divide voltage to voltage vrec, and when the voltage on resistor R11 is lower than reference voltage VREF1, the output ZVD of comparator U10 is reversed, as the start point signal of the cross-zero point of input voltage vrec. Take the condition that R11 is connected to the negative input terminal of the comparator U10, and reference voltage is connected to the positive input terminal of the comparator U10 as an example. When the input voltage is cross-zero, the voltage on resistor R11 is lower than VREF1, and the output ZVD of comparator U10 is changed from low level to high level. After the high-level signal of ZVD is delayed by t2 by the time delay circuit U13, and the time-delay circuit outputs signal ZVDLY is reversed, and is input to the logic circuit U12, and the logic circuit U12 sets the enable mark EN of the bleeder circuit as 1, the bleeder circuit is enabled, and the bus voltage vrec is pulled down to be close to 0V. When the output ZVD of comparator U10 is low, i.e., time t01 in FIG. 3, the logic circuit U12 starts to count time, and the timing signal BLT changes from low to high. The input current detecting circuit of driving circuit detects current iin2; when the voltage RS on the current sample resistor R40 is lower than reference voltage VREF4, i.e., between t01 to t02, the bleeder circuit U03 continues to be enabled. When the voltage RS is higher than the reference voltage VREF4, the output signal ZC of the comparator U40 is reversed, the timing of logic circuit U12 is finished, and the timing signal BLT is changed from high to low, and meanwhile the bleeder circuit U03 is not enabled, i.e., the bleeder circuit does not generate bleeder current. t01 to t02 is time t1 that the bleeder circuit generates power consumption, i.e., BLT is high between t01 to t02. The timing signal BLT is connected to the input terminal of the time comparison circuit U14, and when t1 is greater than T, the time comparison circuit U14 outputs time-delay direction mark BLRDIR as high level; otherwise, the time delay direction mark BLDIR is low level. The time delay circuit U13 adjusts the delayed time t2 of the input voltage cross-zero point signal ZVD according to the time-delay direction mark BLDIR, and t1 is adjusted as T or close to T. The minimum value of time delay t2 is 0, and the maximum is a half power frequency cycle or more.

Figure 7:
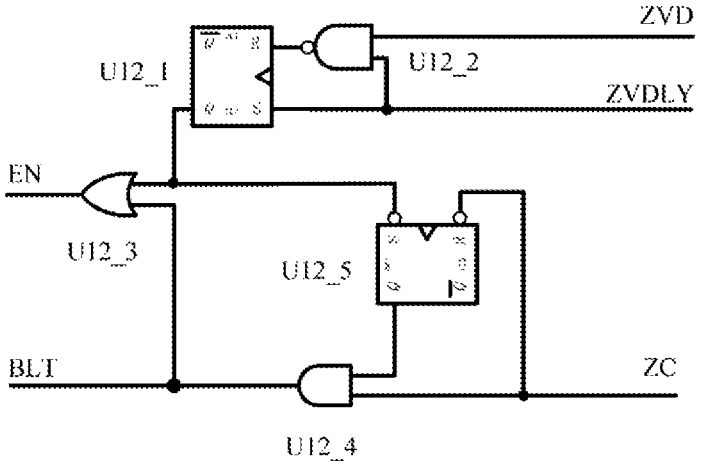
FIG. 7 is a structural schematic view of a logic circuit of embodiment one of the bleeder circuit of the present disclosure.

FIG. 7 shows a circuit structure of a logic circuit in embodiment one of the bleeder circuit of the present disclosure. The logic circuit includes a first trigger U12_1 and a second trigger U12_5, and the time delay module outputs a state signal ZVDLY indicating whether the time delay is finished, and the set terminal S of the first trigger receives the state signal ZVDLY which indicates whether the time delay is finished, and the output terminal of the input voltage detecting circuit and the output terminal of the time delay module U13 are accessed to the NAND gate U12_2, and the output terminal of the NAND gate U12_2 is connected to the reset terminal of the first trigger U12_1; the output terminal of the first trigger U12_1 is connected to the set terminal of the second trigger after it is reversed, and the out terminal of input current detection circuit of driving circuit is connected to the reset terminal R of the second trigger U12_5 after it is reversed, and the output terminal of the second trigger U12_5 and the output terminal of input current detecting circuit of driving circuit are connected to two input terminals of the AND gate U12_4, and the output terminal of the AND gate U12_4 and the output terminal of the first trigger U12_2 are connected to two input terminals of the OR gate U12_3 respectively, and the OR gate U12_3 outputs a signal EN indicating whether to enable to the bleeder module U03, and the output terminal of the AND gate U12_4 outputs a timing signal BLT indicating the first time. Though the above presents a structure of a specific logic circuit, it may be replaced and is not restricted to the above structure.

Figure 8:
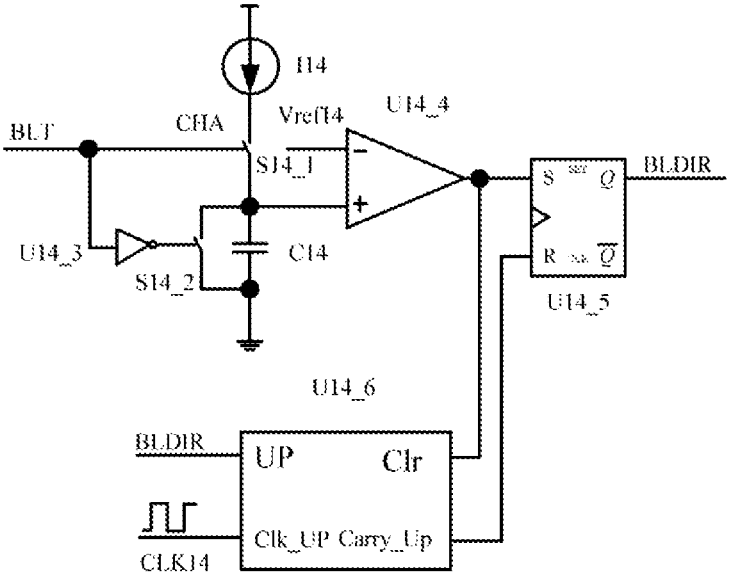
FIG. 8 is a structural schematic view of a time comparison module of embodiment one of the bleeder circuit of the present disclosure.

FIG. 8 shows a circuit structure of a time comparison module in embodiment one of the bleeder circuit of the present disclosure. The effective bleeder time signal BLT generated by the logic circuit U12 controls switch S14_1, S14_2, and when BLT is high, S14_1 is turned on, and the Current source 114 charges the capacitor C14; when the voltage of capacitor C14 is greater than a reference voltage VREF14, it outputs high level signal, and the time delay adding and reducing (i.e., direction) mark signal BLDIR is high, and meanwhile, the counter U14_6 is cleared, meaning that the delay time needs to be prolonged; when the BLT is low, S14_2 is turned on, and C14 discharges.

$$T=C14*Vref14/I14;$$

When BLT time is short than T, the duration time exceeds T5, and counter U14_6 adds to generate carry, U14_5 is reset, and BLDIR is low, meaning that the delay time needs to be shortened.

$$T5=T_{CLK14}*2^{N1}$$

wherein N1 is the number of bits of counter U14_6.

Figure 9:
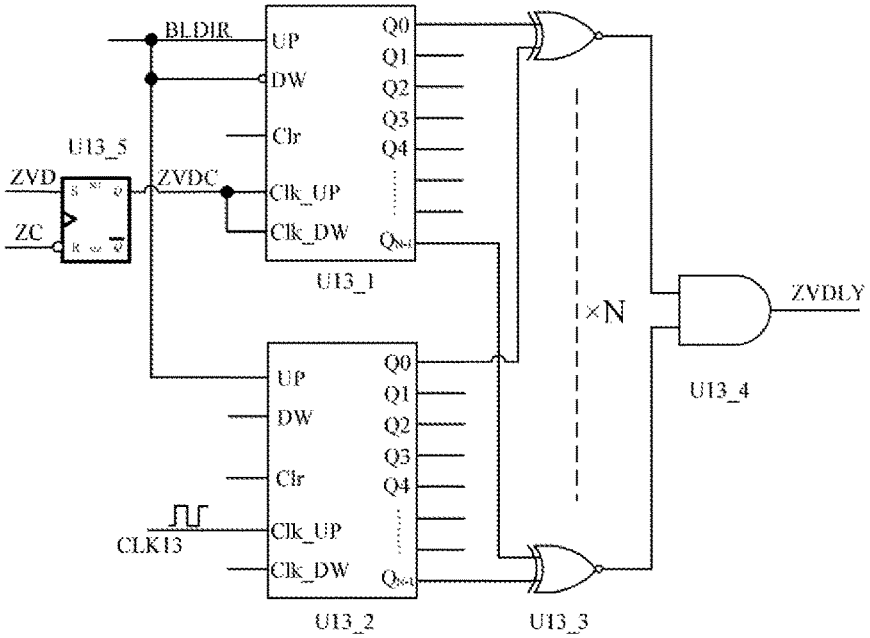
FIG. 9 is a structural schematic view of a time delay module of embodiment one of the bleeder circuit of the present disclosure.

FIG. 9 shows a circuit structure of a delay module in embodiment one of the bleeder circuit of the present disclosure. The time delay adding and reducing (direction) mark are used as the adding and reducing counter enable signals of counters U13_1 and U13_2; CLK 13 is used as the clock signal of the counter U13_2, and its cycle period is the minimum step length of the time delay; when the input voltage is cross zero, the ZVD signal is high level, the R/S trigger U13-5 outputs high level, until when the driving circuit inputs current mark bit (output of U40) ZC is set to 0, R/S trigger U13_5 output is reset to generate a ZVDC signal, as the clock signal of counter U13_1. When signal BLDDIR is 1, counters U13_1, U13_2 add the counts; when the time delay adding and reducing mark signal BLDDIR is 0, counter U13_1 reduces the counts, and the counter U13_2 adds the counts. When the count values of counters U13_1, U13_2 are the same, the XNOR gate U13_3 outputs high level, the AND gate U13_4 outputs high level, and ZVDLY outputs high level, as the cross-zero signal after the ZVD is time delayed, and then a bleeder circuit enable signal is generated by the logic circuit U12.

Figure 10:
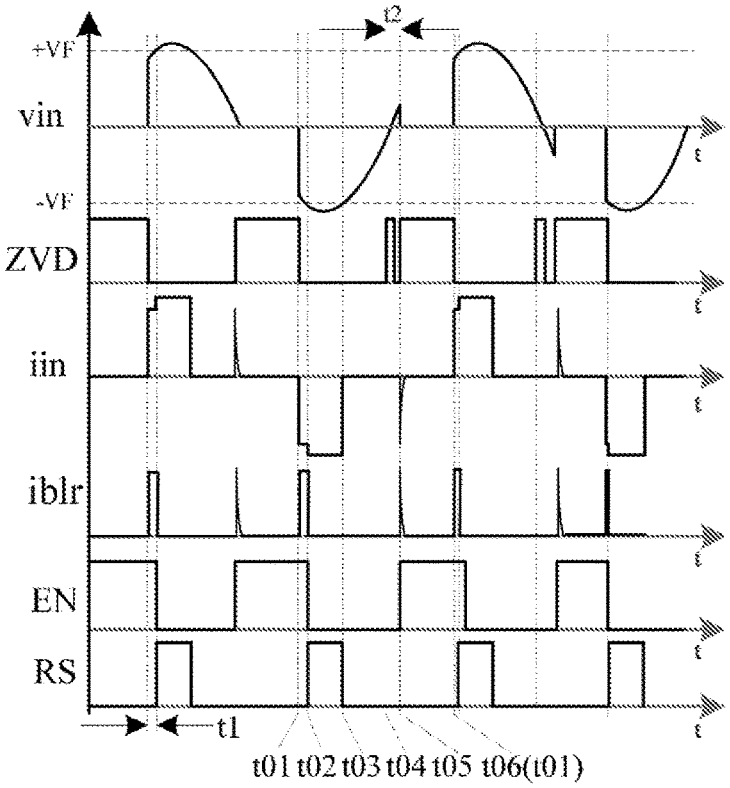
FIG. 10 is a working waveform of embodiment one of the bleeder circuit of the present disclosure.

FIG. 10 shows a working waveform of embodiment one of a bleeder circuit of the present disclosure. It shows the corresponding specific waveforms of input voltage Vin, input current iin, bleeder circuit iblr, enable signal EN, and sample signal RS. It can be seen from the figure that during the initial power-on, the working time of the bleeder current iblr is long, and after the time-delay process, the iblr time is shorter and shorter, until it is maintained within the minimum bleeder time T, and this ensures that the bleeder circuit has lower power consumption.

Figure 11:
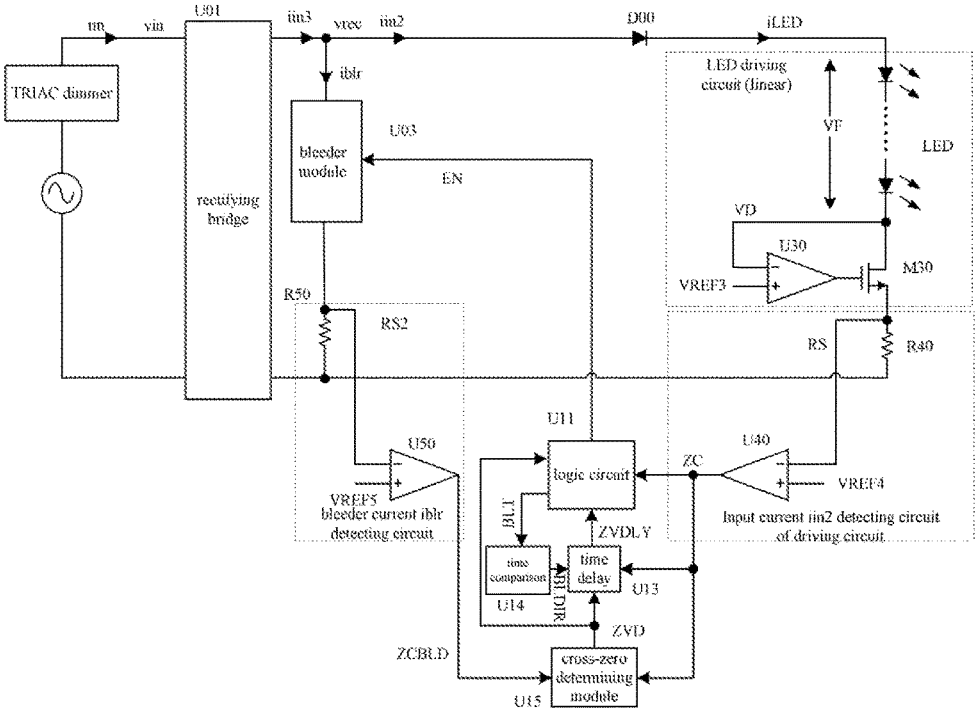
FIG. 11 is a circuit structural diagram of embodiment two of the bleeder circuit of the present disclosure.

FIG. 11 shows the circuit structure of embodiment two of the bleeder circuit of the present disclosure. This solution can also achieve the effect of the above solution without the input voltage vrec detecting circuit, and simplifies the peripheral elements, i.e., detecting the cross-zero point of the input voltage by other ways, but it needs to add the bleeder current iblr detecting circuit.

In this embodiment, the bleeder control circuit includes a input current detecting circuit of driving circuit, a bleeder current detecting circuit, and a logic circuit U11, and the logic circuit U11 is connected to the control terminal of the bleeder module U03, and the input current detecting circuit of driving circuit samples the driving circuit input current, and compares it with the threshold current, when detecting input voltage cross-zero if enabled, the bleeder current detecting circuit functions, the logic circuit controls the bleeder module to generate a bleeder current and samples the bleeder current by resistor R50, and compares it with the bleeder threshold (indicated by VREF4); when the driving circuit input current is lower than the threshold current VREF4 (the reference signal indicates a low threshold close to zero), i.e., the driving circuit input current is close to zero or cross-zero, timing starts until the bleeder circuit iblr achieves the bleeder threshold, timing is finished, and the timing time is used as the third time T3, and after the driving circuit input current achieves the threshold current and the third time T3 later, it is determined that the input voltage achieves the cross-zero point.

When it is determined that the input voltage achieves the cross-zero point, after time delay for the second time t2, bleeder module is controlled by logic circuit U11 to generate a bleeder current iblr; the input current detecting circuit of driving circuit detects the driving circuit input current, and when the sample current achieves the threshold current indicating the predetermined value, the bleeder current ibir is zero after being controlled by the logic circuit U11; compare the first time t1 with the reference time T, and adjust the second time t2 correspondingly according to the comparison result.

The bleeder control circuit further includes a time-delay module U13, a time comparison module U14, and a cross-zero determining module U15, and the time-delay module U13 is connected to the output terminal of the cross-zero determining module U15, the logic circuit U11, and the time comparison module U14, and the cross-zero determining module U15 is also connected to the output terminal of the bleeder current control circuit and the output terminal of the input current detecting circuit of driving circuit; the cross-zero determining module times the third time T3, and determines the cross-zero time of the input voltage, and the time-delay module receives the signal indicating the cross-zero time output by the cross-zero determining module, and delays for a second time t2; after the time delay is finished, bleeder current iblr is generated by the logic circuit U11; the time comparison module U14 compares the first time t1 with the reference time T, and the comparison result feedback to the time delay module to adjust the second time t2.

Figure 12:
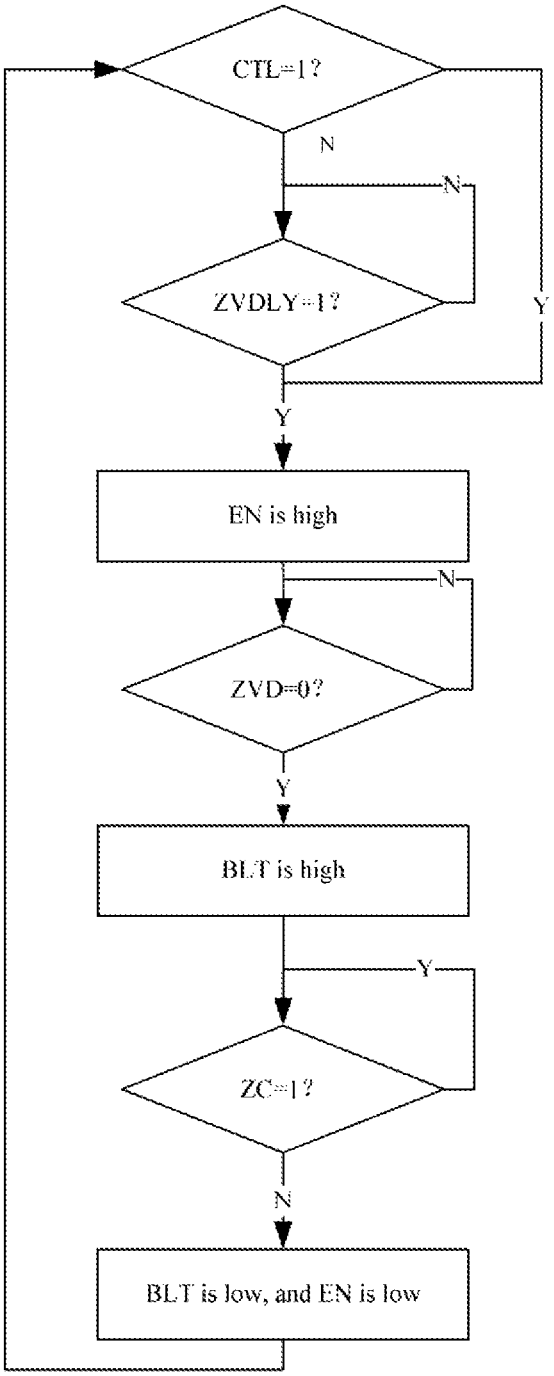
FIG. 12 is a flowchart diagram of a logic circuit of embodiment two of the bleeder circuit of the present disclosure.

FIG. 12 shows a flowchart block diagram of logic circuit U11 of embodiment two of the bleeder circuit of the present disclosure. By combining this figure with FIG. 11, it is obtained that the specific steps of embodiment two are: The initial value of the second time t2 is 0. The AC power supply may get rectified voltage vrec by TRIAC dimmer U02, and rectifying bridge U01. The input voltage cross-zero detecting enable signal CTL is for detecting the third time of the input voltage cross-zero time, and in order to ensure the accuracy of the third time and the reducing bleeder power consumption at the mean time, CTL may be a square wave signal far lower than the working frequency. At the initial power-on, the input voltage cross-zero detecting enable signal CTL is high level, and at this time, as long as voltage RS on sample resistor R40 of the driving circuit input current is lower than the reference voltage Vref4, the output terminal of comparator U40 is high level, and the bleeder circuit U03 is enabled. When the input voltage is high, LED current is big, and the voltage of driving circuit sample resistor R40 is higher than VREF4, and comparator U40 outputs low level, the input voltage cross-zero signal ZVD is low level at this time; when the input voltage is reduced from high, the voltage on sample resistor R40 of driving circuit input current is reduced; when voltage RS of the driving circuit input current sample resistor R40 is lower than VREF4, output of comparator U40 is reversed, and bleeder circuit U03 is enabled, and the cross-zero detecting circuit U15 of input voltage starts to count time; the voltage on sample resistor R50 of the bleeder current iblr is higher than a reference voltage VREF5, and comparator U50 outputs a low level; the input voltage continues to decrease, and when it is close to 0V, the bleeder current iblr is reduced to be close to 0, and the voltage on sample resistor R50 of the bleeder current iblr is lower than a reference voltage VREF5, and comparator U50 outputs high level, and the input voltage cross-zero signal ZVD becomes high level, and meanwhile, the counting of the cross-zero detection circuit U15 of input voltage is finished, and counting time is T3, i.e., the time between the time that the driving circuit input current iin2 falls down along the cross-zero point and the input-voltage cross-zero is time T3.

Figure 13:
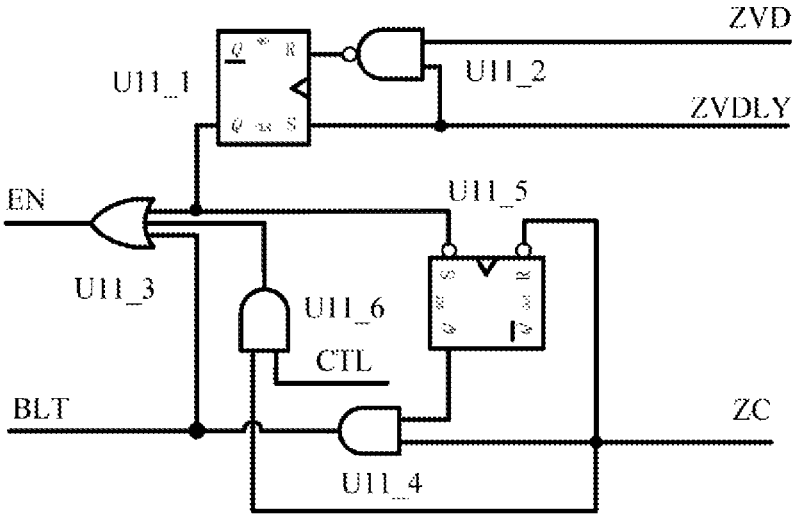
FIG. 13 is a structural schematic view of a logic circuit in embodiment two of bleeder circuit of the present disclosure.

When the cross-zero detecting signal CTL of input voltage is at low level, at each working frequency period after that, when the voltage on sample resistor R40 of the driving circuit input current changes from being higher than the reference voltage VREF4 to being lower than the reference voltage VREF4 (the rising edge of comparator U40), T3 is delayed to generate the input voltage cross-zero point signal ZVD. After the high level of ZVD is delayed by t2 after the time delay U13, it passes through the logic circuit U1; the logic circuit U11 sets the working mark of the bleeder circuit to 1, and the bleeder circuit is enabled, and the bus voltage vrec is pulled down to be close to 0V. When the output ZCBLD of the bleeder current detecting comparator U50 is low, i.e., time t01 in FIG. 15, the time comparison circuit U14 starts to work. The input current detecting of driving circuit circuit detects current iin2, and when voltage Rs on the current sample resistor R40 is lower than the reference voltage VREF4, i.e., between t01 to t02, the bleeder circuit U03 continuous to enable. When voltage RS is higher than the reference voltage VREF4, the output signal ZC of comparator U40 is reversed, and the work time comparison circuit U14 is finished, and meanwhile the bleeder circuit U03 is not enabled, i.e., the bleeder circuit does not generate bleeder current. From t01 to t02, it is power consumption time t1 of bleeder circuit, and when t1 is greater than T, the time comparison circuit output delay time mark BLRDIR, which is a high level; in contrast, the time delay direction mark BLDIR is low level. The time delay circuit U13 adjusts the delay time t2 after the cross-zero point signal ZVD of input voltage according to the time delay directing mark BLDIR, and adjusts t1 to T or be close to T, wherein the minimum value of time delay t2 is 0, and the maximum value is a half working frequency period or more. FIG. 13 shows a circuit structure of a logic circuit in embodiment two of the bleeder circuit of the present disclosure. When the cross-zero point detecting enable signal CTL of input voltage is high level, as long as the driving circuit input current iin2 is lower than a set value, i.e., when ZC is a high level, the AND gate U11_6 outputs high level, and OR gate U11_3 with three input outputs high level, and the bleeder circuit is enabled, and the zero-point detecting circuit U15 of input voltage detects the input voltage cross-zero point, as 0-t07 in FIG. 15, from 0-t07, and time T3 is saved. When the cross-zero detecting enable signal CTL of input voltage is low level, the AND gate U11_6 outputs low level. When the input current iin2 detecting circuit of driving circuit output ZC is turned from low level to high level (t03), time T3 is delayed, and the ZVD signal is changed from low level to high level, and at this time, even if ZC is high level, R/S trigger U11_1 (reset at time t01), and U11_5 (reset at time t02) output low level, the AND gate U11_4 outputs low level, and the bleeder circuit is not enabled. R/S trigger U11_1 outputs high level until the time delay circuit U13 output signal ZVDLY is set to 1, and the bleeder circuit enable signal EN is high level; the bleeder circuit is enabled, and the input voltage vrec is 0, until the TRIAC dimmer is turned on, and ZVD is low; R/S trigger U11_1 outputs low level, and U11_5 outputs high level; at this time, if ZC is high, the AND gate U11_4 outputs high level, and the bleeder circuit enable signal EN continues to be high level, to keep the input current to ensure the stable turn-on of the TRIAC; the output of U11_4 and U11_5 are reset until ZC is low, the bleeder circuit enable signal EN is low, and the bleeder circuit stops work. The output of the AND gate U11_4 is the time signal BLT (t01~t02) that the bleeder circuit generates power consumption.

Figure 14:
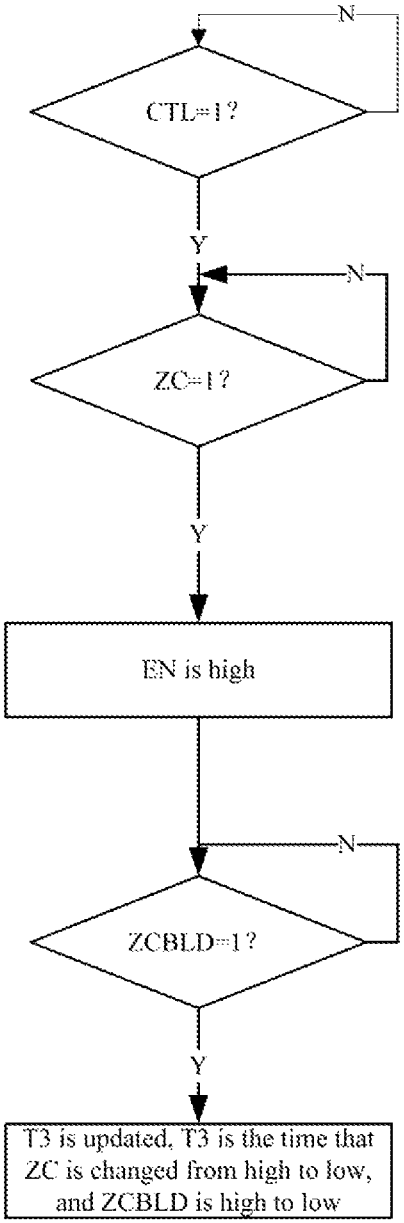
FIG. 14 is a flowchart diagram of a cross-zero determining module in embodiment two of the bleeder circuit of the present disclosure.

FIG. 14 shows a flowchart of the work of cross-zero determining module U15 in embodiment two of the bleeder circuit of the present disclosure. The cross-zero determining module U15 detects and saves the cross-zero point of the driving circuit input current iin2 and the cross-zero point time of the bleeder current iblr. When the cross-zero determining module U15 is enabled, it is determined whether the driving circuit input current is lower than the threshold current. When it is lower than the threshold current, the bleeder module is enabled to generate bleeder current. When the bleeder current is lower than a corresponding threshold, the time is saved, and the third time T3 is updated. The third time T3 is the time between ZC is changed from high to low and ZCBLD is changed from high to low.

Figure 15:
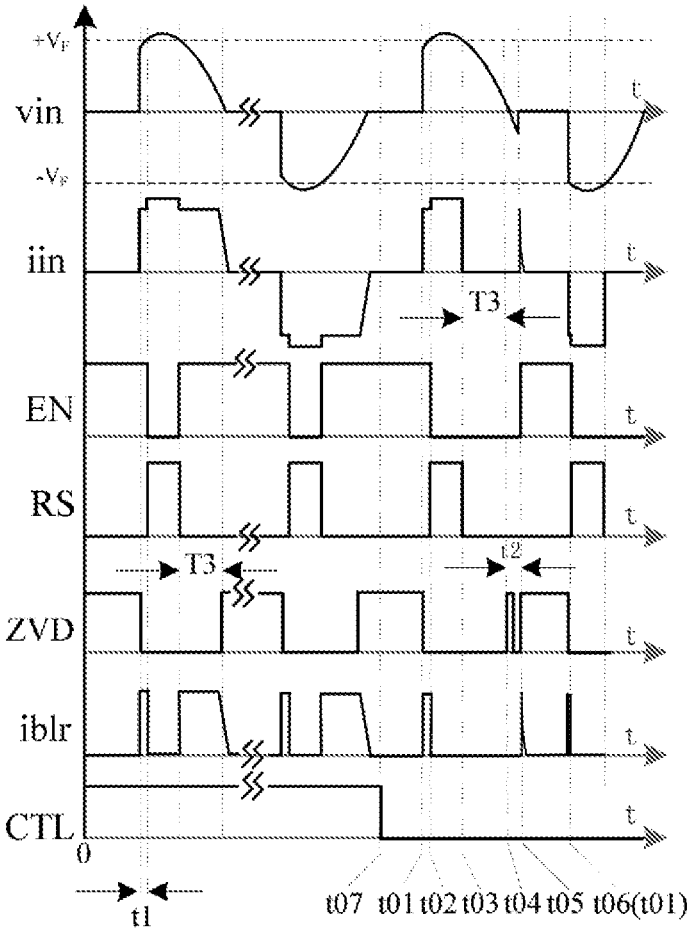
FIG. 15 is a working waveform of embodiment two of the bleeder circuit of the present disclosure.

FIG. 15 shows a working waveform of embodiment two of the bleeder circuit of the present disclosure, and it shows the specific waveforms corresponding to the input voltage Vin, input current iin, bleeder circuit iblr, enable signal EN, CTL, and sample signal RS. It can be seen from the drawing that similar to embodiment one, at the initial power-on, the working time of the bleeder current iblr is long, and after the time delay process, the iblr time is shorter and short, until it is maintained in the minimum bleeder time T, ensuring that the bleeder circuit has lower power consumption.

Besides said above, though the above describe and explain the embodiments separately, for part of the common technologies, those of ordinary skill in the art may replace and integrate among the embodiments, and for the contents not clearly described in one embodiment, it may refer to another embodiment which have description.

The above implementing manners are not restrictions to the protection scope of the technical solution. Any amendments, equivalent replacement and improvements made within the spirits and principles of the above implement manners shall be contained in the protection scope of the technical solution.

What is claimed is:

1. A bleeder circuit, comprising:

a) a bleeder module, having alternating current (AC) input through a triode alternating current (TRIAC) dimmer and a rectifying bridge to get input voltage to provide a load with power supply through a driving circuit, two ends of the bleeder module being connected to high and low potential terminals of an input voltage detecting circuit respectively; and b) a bleeder control circuit, connected to a control terminal of the bleeder module; directly or indirectly detecting cross-zero point of input voltage; after the cross-zero point of input voltage is delayed by a second time, the bleeder module works to generate bleeder current, and a time between turn-on time of the TRIAC dimmer and a time that a driving circuit input current achieves a predetermined value is a first time;

wherein, when the first time is greater than a reference time, the second time is prolonged; and when the first time is smaller than the reference time, the second time is reduced, such that the first time is close to the reference time;

wherein the bleeder control circuit comprises an input voltage detecting circuit, an input current detecting circuit of a driving circuit, and a logic circuit; the logic circuit is connected to a control terminal of the bleeder module, and the input voltage detection circuit samples the input voltage; when the input voltage sample signal achieves a threshold voltage, after being delayed for a second time, the bleeder module is controlled by the logic circuit to generate bleeder current; the input current detecting circuit of the driving circuit detects the input current of the driving circuit, and when the sample current achieves a threshold current indicating a predetermined current, the bleeder current is controlled by the logic circuit to be zero; comparing the first time with the reference time, and adjusting the second time correspondingly according to the comparison result.

2. The bleeder circuit of claim 1, wherein the bleeder control circuit further comprises a time-delay module and a time comparison module, the time delay module being connected to an output terminal of the input voltage detection circuit, the logic circuit and the time comparison module, and the time delay module adjusts the second time such that, when the input voltage sample signal achieves the threshold voltage, delaying the second time, and after the delay is finished, controlled by the logic circuit to generate bleeder current, comparing the first time with the reference time in the time comparison module, and feeding back comparison result to the time delay module to adjust the second time.

3. The bleeder circuit of claim 2, wherein the logic circuit comprises a first trigger and a second trigger; the time delay module outputs a state signal to indicate whether time delay is finished, and a set terminal of the first trigger receives the state signal to indicate whether the time delay is finished, and an output terminal of the input voltage detecting circuit and the output terminal of the time-delay module are connected to an NAND gate respectively, the output terminal of the NAND gate being connected to a reset terminal of the first trigger; the output terminal of the first trigger is connected to the set terminal of the second trigger after it is reversed; the output terminal of the input current detecting circuit of driving circuit is connected to the reset terminal of the second trigger after it is reversed; the output terminal of the second trigger and the output terminal of the input current detecting circuit of driving circuit are connected to two input terminals of an AND gate respectively, the output terminal of the AND gate and the output terminal of the second trigger are connected to two input terminals of an OR gate respectively, the OR gate outputs a signal indicating whether to enable to the bleeder module, and the output terminal of the AND gate outputs a timing signal indicating the first time.

4. An LED control circuit, comprising the bleeder circuit of claim 1, and an LED driving circuit of, wherein the LED driving circuit is a linearly driving circuit or a switching circuit.

5. A bleeder circuit, comprising:

a) a bleeder module, having alternating current (AC) input through a triode alternating current (TRIAC) dimmer and a rectifying bridge to get input voltage to provide a load with power supply through a driving circuit, two ends of the bleeder module being connected to high and low potential terminals of an input voltage detecting circuit respectively; and b) a bleeder control circuit, connected to a control terminal of the bleeder module; directly or indirectly detecting cross-zero point of input voltage; after the cross-zero point of input voltage is delayed by a second time, the bleeder module works to generate bleeder current, and a time between turn-on time of the TRIAC dimmer and a time that a driving circuit input current achieves a predetermined value is a first time;

wherein, when the first time is greater than a reference time, the second time is prolonged; and when the first time is smaller than the reference time, the second time is reduced, such that the first time is close to the reference time;

wherein the bleeder control circuit comprises an input current detecting circuit of the driving circuit, the bleeder current detecting circuit, and a logic circuit, the logic circuit being connected to the control terminal of the bleeder module, the input current detecting circuit of the driving circuit samples the driving circuit input current and compares it with the threshold current; during detection of the input voltage cross-zero point, the bleeder current detecting circuit, when the logic circuit controls the bleeder module to generate bleeder current, samples the bleeder current, and compares it with the bleeder threshold; when the input current of the driving circuit is lower than the threshold current, timing starts, and timing is finished when the bleeder current achieves the bleeder threshold, the timing time being used as a third time.

6. The bleeder circuit of claim 5, wherein when the input current of the driving circuit is lower than the threshold current, determining that the input voltage achieves the cross-zero point after the third time passes, and updating the third time regularly or irregularly.

7. The bleeder circuit of claim 5, wherein when it is determined that the input voltage achieves the cross-zero point and then the second time is delayed, the bleeder module is controlled by the logic circuit to generate bleeder current; the input current detecting circuit of the driving circuit detects the input current of the driving circuit, and when the sample current achieves the threshold current indicating a predetermined value, the bleeder current is zero after being controlled by the logic circuit; comparing the first time and the reference time, and adjusting the second time correspondingly according to the comparison result.

8. The bleeder circuit of claim 7, wherein the bleeder control circuit further comprises a time delay module, a time comparison module, and a cross-zero determining module; the time delay module being connected to the output terminal of the cross-zero determining module, the logic circuit, and the time comparison module respectively, the cross-zero determining module being connected to the output terminal of the bleeder current detecting circuit and the output terminal of the input current detecting circuit of the driving circuit respectively; timing the third time by the cross-zero determining module, and determining the cross-zero time of the input voltage; the time-delay module receives a signal indicating the cross-zero time output by the cross-zero determining module, and then delays the second time; after the time delay is finished, bleeder current is generated by the bleeder circuit by controlling the logic circuit; comparing the first time and the reference time in the time comparison module, and feeding back the comparison result to the time delay module to adjust the second time.

9. The bleeder circuit of claim 8, wherein the logic circuit comprises a third trigger and a fourth trigger, and the time delay module outputs a state signal to indicate whether the time delay is finished; the set terminal of the third trigger receives the state signal to indicate whether the time delay is finished; the output terminal of the cross-zero determining module and the output terminal of the time delay module are connected to the NAND gate respectively, and the output terminal of the NAND gate is connected to the reset terminal of the third trigger; the output terminal of the third trigger is connected to the setting terminal of the fourth trigger after it is reversed, the output terminal of the input current detecting circuit of driving circuit is connected to the reset terminal of the fourth trigger after it is reversed; the output terminal of the fourth trigger and the output terminal of the input current detecting circuit of the driving circuit are connected to two input terminals of the first AND gate, and the output terminal of the input current of the driving circuit and the signal indicating whether the cross-zero determining module is enabled to access the input terminals of the second AND gate; the output terminal of the first AND gate, the output terminal of the second AND gate, and the output terminal of the third trigger are connected to three input terminals of an OR gate, the OR gate outputs the signal to indicate whether to enable to the bleeder module, the output terminal of the first AND gate outputs a timing signal indicating the first time.

10. An LED control circuit, comprising the bleeder circuit of claim 5, and an LED driving circuit of, wherein the LED driving circuit is a linearly driving circuit or a switching circuit.

* * * * *